United States Patent [19]

Manzalini

[11] Patent Number: 5,076,015

[45] Date of Patent: Dec. 31, 1991

[54] DEVICE FOR THE SUTTER-LIKE AND TILT-DOWN OPENING OF A WINDOW OR DOOR-WINDOW

[75] Inventor: Norberto Manzalini, Conegliano, Italy

[73] Assignee: Otlav S. p. A., Italy

[21] Appl. No.: 529,428

[22] Filed: May 29, 1990

[30] Foreign Application Priority Data

Jun. 1, 1989 [IT] Italy ..... 82552 A/89

[51] Int. Cl.[5] ..... E05D 15/52

[52] U.S. Cl. ..... 49/192; 292/38

[58] Field of Search ..... 49/192, 395; 292/38, 292/DIG. 17

[56] References Cited

U.S. PATENT DOCUMENTS

| | | | |
|---|---|---|---|
| 913,269 | 2/1909 | Dalhouse | 292/38 |
| 2,976,070 | 3/1961 | Gollbach . | |
| 3,027,188 | 3/1962 | Eichstadt | 292/38 X |
| 3,344,465 | 10/1967 | Neumeister | 292/38 X |
| 3,368,306 | 2/1968 | Von Wedel et al. | 49/192 |
| 3,406,483 | 10/1968 | Mitchell | 49/192 |
| 3,434,238 | 3/1969 | Muller | 49/192 |
| 3,667,162 | 6/1972 | Lalague | 49/192 |
| 3,834,747 | 9/1974 | Slovesky | 292/38 |
| 3,910,611 | 10/1975 | Slovesky | 292/38 |
| 3,911,621 | 10/1975 | McHeffey | 49/192 |
| 4,074,462 | 2/1978 | McHeffey | 49/192 |
| 4,208,838 | 6/1982 | Kleine et al. | 49/192 |
| 4,339,892 | 7/1983 | Ulbright et al. | 49/192 |
| 4,392,329 | 7/1983 | Suzuki | 49/395 X |
| 4,461,160 | 7/1984 | Van Grompel | 292/38 X |
| 4,541,200 | 9/1985 | Gartner | 49/192 |
| 4,602,457 | 7/1986 | Kreusel | 49/192 |
| 4,624,075 | 11/1986 | Vigreaux | 49/192 |

FOREIGN PATENT DOCUMENTS

| | | | |
|---|---|---|---|
| 51309 | 5/1982 | European Pat. Off. | 49/192 |
| 385414 | 2/1990 | European Pat. Off. | 49/192 |
| 855509 | 7/1949 | Fed. Rep. of Germany | 49/192 |
| 4749 | 5/1956 | Fed. Rep. of Germany | 49/192 |
| 1113162 | 2/1958 | Fed. Rep. of Germany | 49/192 |
| 1459039 | 9/1969 | Fed. Rep. of Germany | 49/192 |
| 2143979 | 3/1973 | Fed. Rep. of Germany | 49/192 |
| 2206764 | 8/1973 | Fed. Rep. of Germany | 49/192 |
| 2231092 | 1/1974 | Fed. Rep. of Germany | 49/192 |
| 2240345 | 7/1974 | Fed. Rep. of Germany | 49/192 |
| 2734317 | 2/1979 | Fed. Rep. of Germany . | |
| 810435 | 3/1937 | France . | |
| 1261587 | 7/1960 | France | 292/38 |
| 2117024 | 7/1972 | France . | |
| 2166636 | 8/1973 | France . | |
| 47936 | 4/1965 | Luxembourg . | |
| 421746 | 4/1967 | Switzerland . | |
| 436024 | 11/1967 | Switzerland | 49/192 |
| 2161201 | 1/1986 | United Kingdom . | |
| 2190704 | 11/1987 | United Kingdom . | |

*Primary Examiner*—Gary L. Smith
*Assistant Examiner*—Jerry Redman
*Attorney, Agent, or Firm*—Guido Modiano; Albert Josif

[57] ABSTRACT

The present invention relates to a device for the shutter-like and tilt-down opening, with respect to a fixed frame, of a window or door-window composed of an upper cross-member and a lower cross-member connected by a pair of uprights on one of which handle is rotatably associated. The peculiarity of the device consists in the fact that it compirses box, arranged on one of the uprights, which is provided with means, actuated by the handle, for tensioning at least one traction element such as cable. This at least one traction element can be advantageously constituted by a first and second cable which actuate a plurality of pins for the temporary closure of the window onto the fixed frame and for coupling to an upper hinge for shutter-like or tilt-down opening. The device futhermore comprises a lower spherical hinge which is provided with a friction action for shutter-like opening and with an articulation action for tilt-down opening. The box finally comprises means adapted to prevent the rotation of the handle starting from the tilt-down condition ot the shutter-like position.

35 Claims, 6 Drawing Sheets

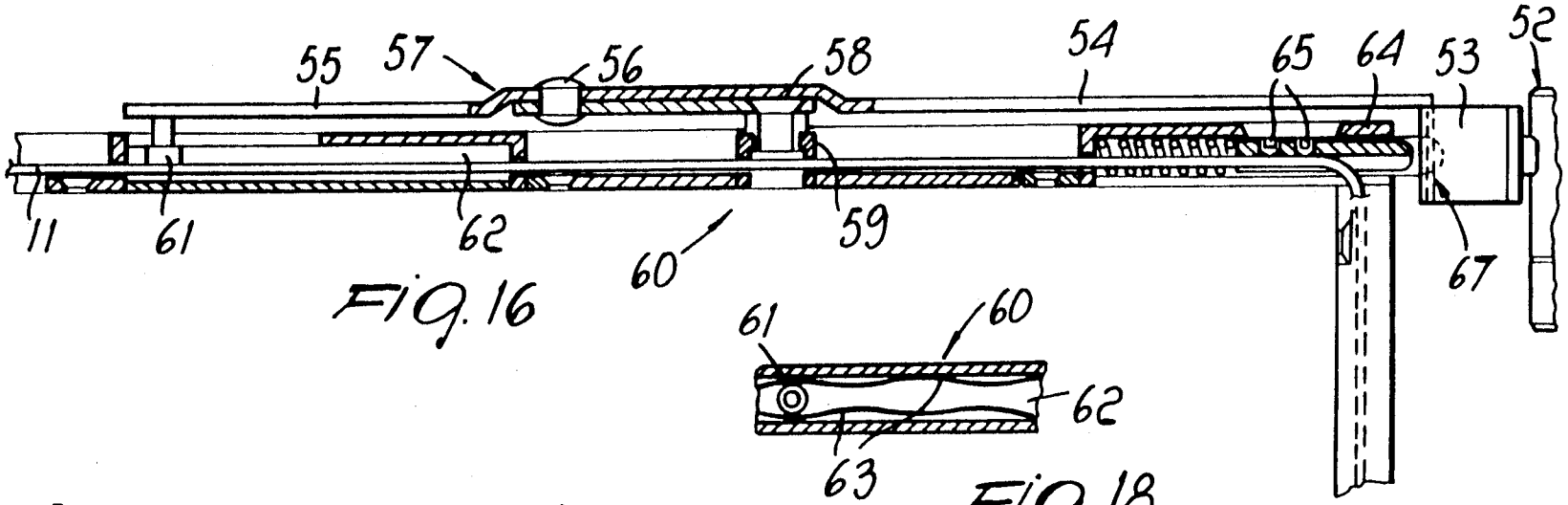
FIG. 16
FIG. 18
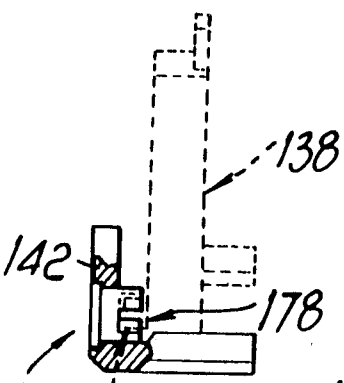
FIG. 20
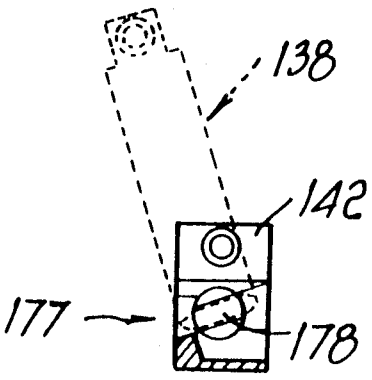
FIG. 19
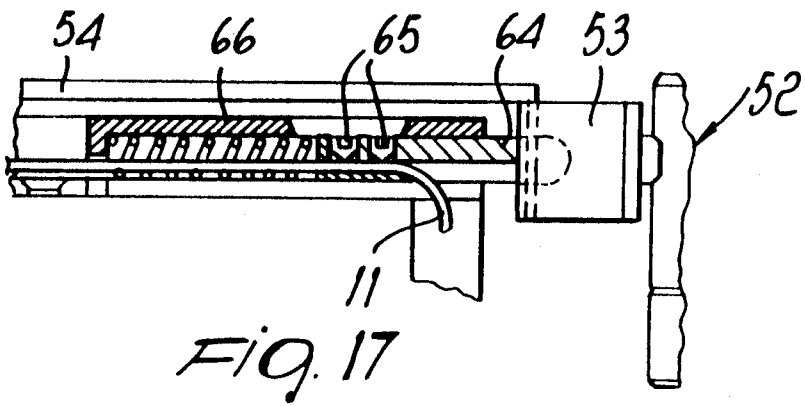
FIG. 17

DEVICE FOR THE SUTTER-LIKE AND TILT-DOWN OPENING OF A WINDOW OR DOOR-WINDOW

BACKGROUND OF THE INVENTION

The present invention relates to a device for the shutter-like and tilt-down opening of a window.

Devices are currently known which allow to open a window in a shutter-like manner, that is to say therefore with a lateral rotary motion, and in a tilt-down manner, therefore along the axis of the lower cross-member, so as to provide an upper opening.

A device is therefore known which comprises a rod which is mounted on an upright and is usually termed "cremone bolt"; said rod, actuated by a handle, acts by means of adapted devices on the arm of the upper supporting hinge and on a tilt-down abutment which is applied to the lower corner of the window and is adapted to allow shutter-like and tilt-down rotations.

This known kind of device is structurally very complicated, since it is composed of a plurality of parts which can be mutually assembled; said device must furthermore be adapted according to the specific dimensions of the windows, so that some of its components must be shaped to size during assembly.

The composition of this known system is further complicated by the fact that if it is to be applied on irregular or "vaulted" windows it is necessary to further adapt its components to the specific shape of said window.

Said devices are made of galvanized steel: the zinc plating wears at the points of contact between the fixed points and the movable points, allowing the forming of rust which compromises operation in the course of time.

SUMMARY OF THE INVENTION

The aim of the subject of the present application is therefore to eliminate the disadvantages described above in known kinds by providing a device which, when applied to a window, allows to achieve the optimum shutter-like and tilt-down opening thereof.

Within the scope of the above described aim, another important object is to provide a device which is structurally simple so as to allow rapid assembly thereof onto windows.

Another important object is to provide a device which can be applied to windows of different sizes in a rapid and easy manner, without forcing the installer to keep in stock a considerable number of parts according to the specific installation to be performed.

Another important object is to provide a device which has a structurally simple safety against incorrect shutter-like opening maneuver starting from the tilt-down opening condition.

Not least object is to provide a device which associates the preceding characteristics with that of having modest costs and of being reliable and safe in use and in the course of time.

The above described aim and objects and others which will become apparent hereinafter are achieved by a device for the shutter like and tilt-down opening, with respect to a fixed frame, of a window or door-window composed of an upper cross-member and a lower cross-member connected by a pair of uprights, a handle being rotatably associated on one of said uprights, characterized in that it comprises a box, arranged on one of said uprights, which is provided with means, actuated by said handle, for tensioning at least one traction element which actuates a plurality of pins for the temporary closure onto said fixed frame and for coupling to an upper hinge for shutter-like or tilt-down opening, said device comprising a lower spherical hinge with friction means for shutter-like opening and articulated for tilt-down opening, said box comprising means adapted to prevent the rotation of said handle from the tilt-down opening condition to the shutter-like opening condition.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein:

FIG. 16 is a partially sectional view of the compass-like arm for the interconnection of the window upper cross-member and the upper hinge for shutter-like or tilt-down opening in the tilt-down opening condition;

FIG. 17 is a detail view of the preceding figure in the window shutter-like opening condition;

FIG. 18 is a partially sectional view of the elastic means with which there interacts a pin of the compass-like arm for the tilt-down opening of the window in intermediate positions;

FIGS. 19 and 20 are two partially sectional views of a further embodiment for preventing the lifting and opening of the window in the tilt-down condition;

BRIEF DESCRIPTION OF THE DRAWINGS

Figure 1:
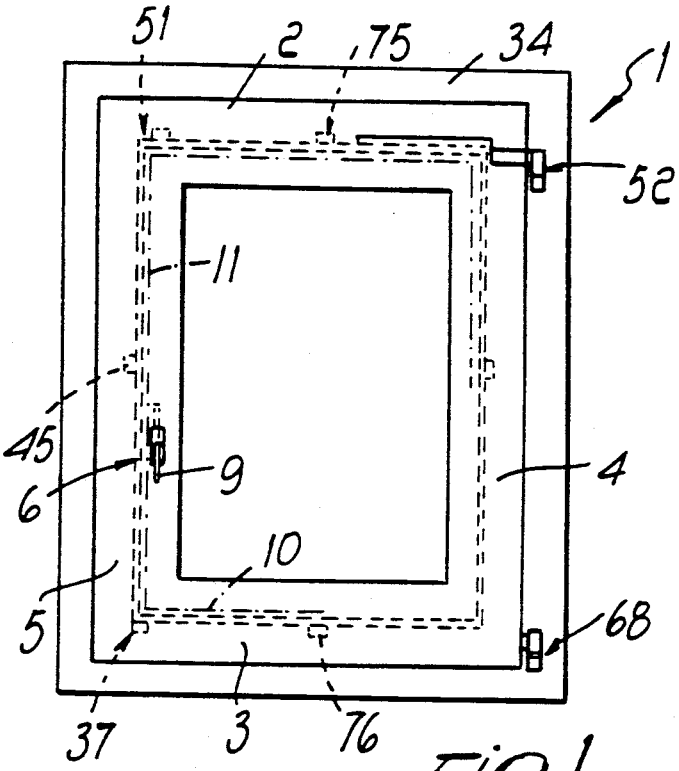
FIG. 1 is a front view of the window.
Figure 2:
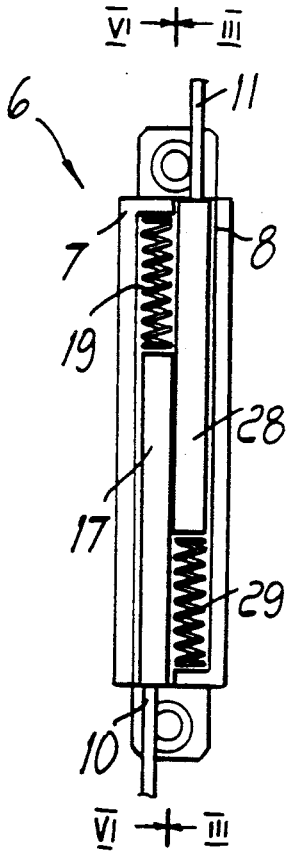
FIG. 2 is a partially sectional front view of the box.

With reference to the above described figures, the reference numeral 1 indicates a window or door-window comprised of an upper cross-member 2 and of a lower cross-member 3 connected by a pair of uprights indicated by the numerals 4 and 5.

In the preferred embodiment of the window 1 shown in FIG. 1, an upper hinge 52 at least temporarily connects the upper portion of the upright 4 of the window to a fixed frame 34. This upper hinge 52 is adapted, as will be described hereafter, to allow the window to open in a shutter-like fashion, in which the upright 4 remains vertical and the window rotates about an axis which is parallel to the extension of the upright 4, or to allow the window to open in a tilt-down manner, in which the window 1 rotates about an axis which is parallel to the extension of the lower cross member 3. Furthermore, a lower hinge 68 which connects the lower portion of the upright 4 to the fixed frame 34 is adapted, as will be described hereafter, to allow the window to achieve both the shutter-like and tilt-down opening as described above. Connection means 37,45 and 51 between the lower, middle and upper portions respectively of the upright 5 and the fixed frame 34 are also provided which are adapted to allow for the shutter-like or tilt-down opening of the window, and such connection means will be described in detail hereafter.

The device for selecting and activating the shutter-like and tilt-down opening of the window 1 comprises a box 6 composed of a first and a second half-shell, indicated by the reference numerals 7 and 8, which are mutually associable.

Said box is arranged at the upright 5, and a handle 9 is associated therewith and can be actuated by the user.

Means are provided within said box 6 for the tensioning of at least one traction element which, in the illustrated embodiment, is constituted by a first cable 10 and by a second cable 11 preferably made of steel.

Such cables 10 and 11 are associated with the upper hinge 52, the lower hinge 68, and the connection means 37 and 51 in such a manner so as to allow the shutter-like or tilt-down opening of the window, depending upon the degree of tensioning of said cables.

Said means for tensioning the cables are constituted by a cam 12 which has an actuation means seat in which the handle 9 is inserted; upon rotation of the handle 9, the cam 12 interacts simultaneously with a first dowel 13 and with a second dowel 14 which have an essentially cylindrical shape.

The cam 12 has a thickness approximately equal to the interspace between said first and said second half-shell and has, at said half-shells, profiles with a substantially mutually inverted configuration.

That is, the cam 12 advantageously has a first side profile which interacts at the first half-shell 7 with the first dowel 13 and a second side profile which interacts at the second half-shell 8 with the second dowel 14. The first side cam profile and the second side cam profile of the cam 12 are substantially mutually inverted, and this configuration, as will be shown hereafter, allows for the shutter-like opening or the tilt-down opening of the window, depending upon the degree of rotation of the cam 12 itself.

Figure 3:
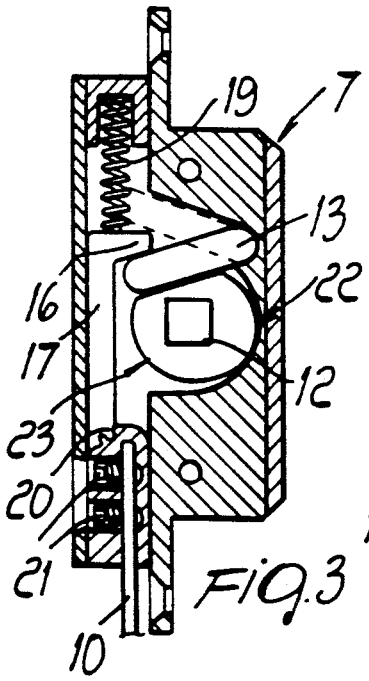
FIG. 3 is a sectional view, taken along the sectional plane III—III of FIG. 2, of the internal components of the box for the actuation of the first cable when the window is closed.
Figure 4:
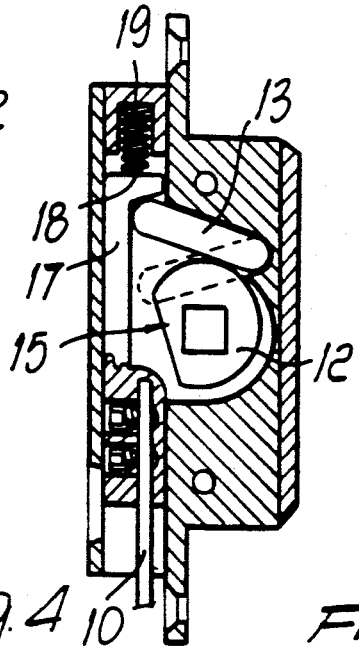
FIG. 4 is a view, similar to the preceding one, of the internal components of the box with the handle rotated counterclockwise by 90° degrees and therefore with the window preset for shutter-like opening.
Figure 5:
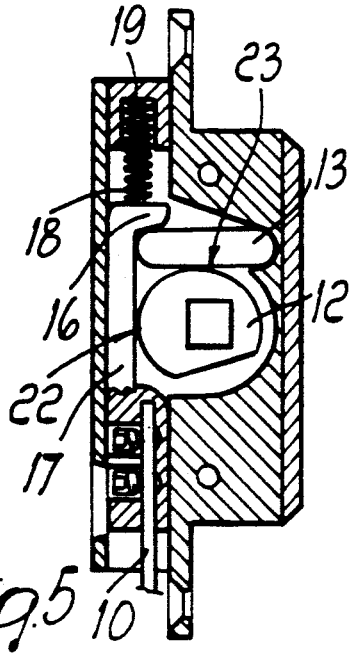
FIG. 5 is a view, similar to the preceding one, of the internal components of the box, wherein the handle has undergone a further 90° rotation so to allow the tilt-down opening of the window.

Taking as reference the first half-shell 7, illustrated in FIGS. 3, 4 and 5, it can be seen that the cam 12 has, at its first side profile, a first planar region 15 on which the first dowel 13 rests when the window is closed; one end of said dowel 13 is accommodated at an adapted seat provided in the first half-shell 7, whereas the other one interacts with a first wing 16 of a first slider 17 which has an essentially L-shaped configuration.

An adapted first pawl 18 is provided at the first wing 16 and protrudes from the opposite side with respect to the one which interacts with the first dowel 13; a first cylindrical-helix compression spring 19 is arranged at said pawl.

The first slider 17 slides at an adapted longitudinal seat provided on the first half-shell 7, and securing means for the first cable 10, such as first Allen screws 21, are associated with the second wing 20 of the first slider 17 thereof.

The cam 12 is furthermore provided, at its first side profile, with a second region 22 which is elliptical and is offset by 90 degrees clockwise with respect to the first region 15; said second region is followed, upon a rotation of another 90 degrees clockwise, by a third circular region 23 with constant radius.

Figure 6:
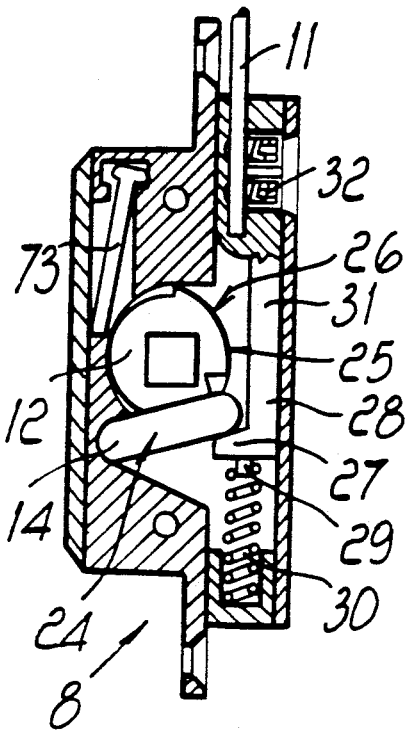
FIG. 6 is a view, taken along the sectional plane VI—VI of FIG. 2, of the internal components of the box for the actuation of the second cable.

Now with reference to the second half-shell 8 as shown in FIG. 6, the cam 12 has, at its second side profile, a fourth planar region 24, which is also planar, at the second half-shell 8; said fourth planar region rests at the facing second dowel 14 when the window is closed.

A fifth circular region 25 with constant radius is provided on the cam 12 at its second side profile after a 90-degree clockwise rotation with respect to said fourth region and is followed, after another clockwise 90-degree rotation, by a sixth elliptical region 26.

At the second half shell 8, too, one end of the second dowel 14 is accommodated, on the opposite side with respect to said first pin relative to the cam, in an adapted seat provided on said second half-shell; the other end interacts with a third wing 27 of a second slider 28 which has an L-shaped configuration and is slidably associated at an adapted seat provided on said second half-shell 8.

A second pawl 29 protrudes at the third wing 27 in the opposite direction with respect to said second dowel 14 and interacts with an adapted second cylindrical-helix compression spring 30.

Fixing means such as second Allen screws 32 for the second cable 11, which protrudes on the opposite side with respect to said first cable 10, are furthermore provided in the second slider 28 at the fourth wing 31.

As shown in FIG. 1, adapted access openings for said first and second Allen screws are naturally provided on said first and on said second half-shells.

Thus, during the actuation of the device, upon a counterclockwise 90-degree rotation imparted to the handle 9 the cam 12 imparts a maximum upward movement to the first slider 17, which is connected to the first cable 10, and simultaneously imparts an intermediate downward movement to the second slider 28 which is connected to the second cable 11.

This condition will allow, as described hereafter, to achieve the shutter-like opening of the window 1.

Figure 11:
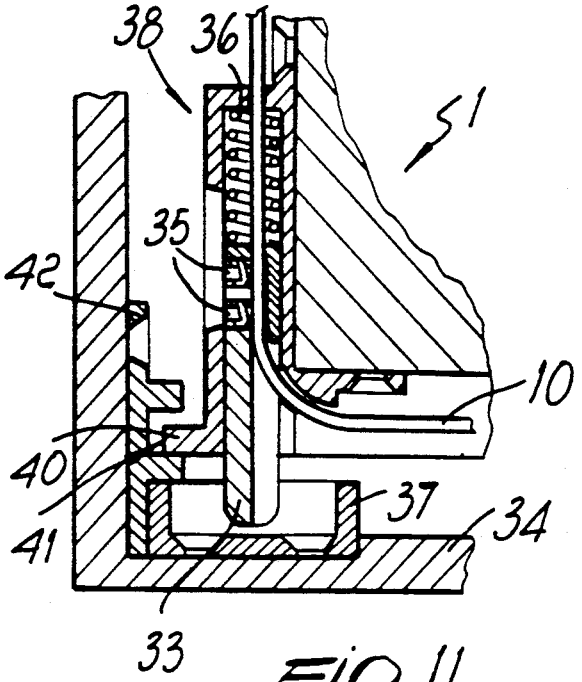
FIG. 11 is a partially sectional view of the lower closure pin.
Figure 12:
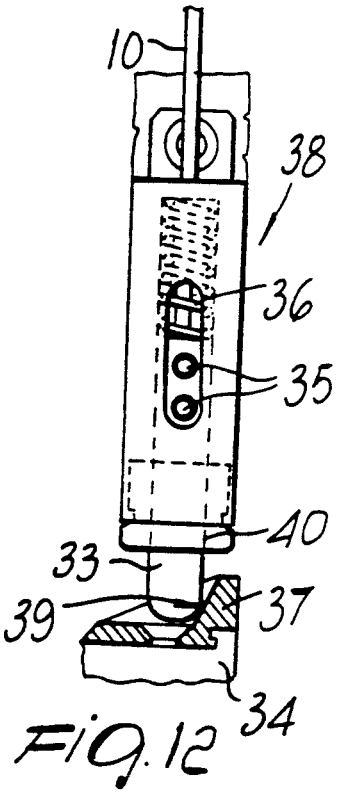
FIG. 12 is a front view of the pin illustrated in the preceding figure which shows its interaction with the frame.
Figure 13:
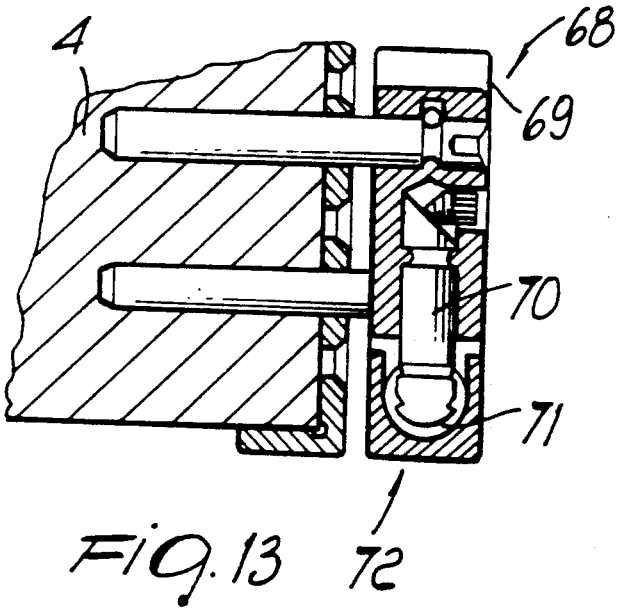
FIG. 13 is a partially sectional view of the lower spherical hinge with friction means for tilt-down opening and articulated for shutter-like opening.
Figure 14:
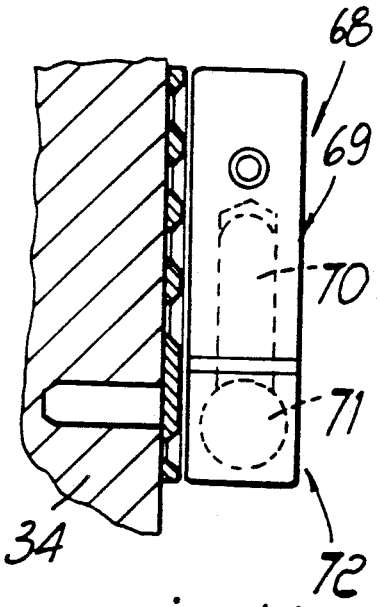
FIGS. 14 and 15 are two other views of the lower spherical hinge.
Figure 15:
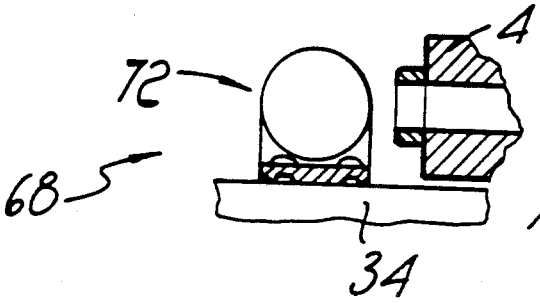

As shown in FIGS. 11 and 12, the first cable 10 is in fact connected to a first pin 33 for the temporary closure of the window onto the fixed frame 34; said first pin is partially hollow for the passage of said first cable and has adapted coupling means for said cable, constituted by third Allen screws 35.

The first pin 33 is therefore adjacent to the upright 5, and its end, which is partially removed toward the lower cross-member 3, is forced to protrude when the window is closed, beyond said cross-member by means of an adapted third cylindrical-helix spring 36, within a first abutment 37 associated with said fixed frame 34.

Said third spring 36 and said first pin 33 are slidably associated in an adapted seat provided longitudinally on a first box-like body 38 which ca be rigidly associated with the upright 5 and is upwardly perforated for the passage of the first cable 10.

As already mentioned, a maximum movement imparted to the first slider 17 corresponds to a 90-degree counterclockwise rotation of the handle 9 and allows the disengagement of the end of said first pin 33 from said abutment 37.

Said abutment is internally provided with a first inclined surface 39 adapted to facilitate the tilt-down opening of the window.

In this last condition, which is equivalent to a 180-degree rotation of the handle 9 starting from the closure condition, the cam 12 interacts with the first dowel 13 at the third region 23 which places said first dowel in an intermediate position which is in any case sufficient to allow the partial protrusion of the free end of the first pin 33 from the first box-like body 38.

Said box-like body furthermore comprises a means adapted to prevent the window from being lifted in the tilt-down condition, said means being constituted by a lug 40 which protrudes on the opposite side with respect to said upright 5 and is accommodated inside an adapted cavity 41 provided on a plate 42 rigidly associated with said fixed frame 34.

We now examine what happens for the second cable 11 upon a counterclockwise 90-degree rotation imparted to the handle to open the window in a shutter-like manner.

Upon such a rotation, the cam 12 interacts with the second dowel 14 at the fifth region 25 with constant radius, thus forcing the second slider 28 to perform an intermediate movement with respect to the maximum movement which can be achieved with a further 90-degree rotation.

A movement of the second slider 28 toward the lower cross-member 3 therefore entails the tensioning of the cable 11, to which the end of a second intermediate closure pin 43 is pivoted.

Said closure pin has an essentially L-shaped configuration, and its other free end protrudes transversely to the upright 5 toward the facing fixed frame 34 within an adapted second abutment 44.

The second pin 43 is accommodated within a second box-like body 45 which is perforated above and below for the passage of the second cable 11, and said second pin 43 is slidably associable therein; its position with respect to the second cable 11 can be determined by means of adapted fourth Allen screws 46 and forced in its positioning by means of an adapted fourth cylindrical-helix compression spring 47 adapted to force said second pin toward the upper cross-member 2.

The orthogonal movement of the free end of the second pin 43 with respect to the second box-like body 45 is allowed since the latter is upwardly provided with a second inclined surface 48 which interacts with the upper end of said second pin 43 during the positioning of the handle 9 from the condition in which the window is open shutter-like to the condition in which the window is closed by virtue of the presence of the fourth spring 47.

Vice versa, the transverse translatory motion of the free end of the second pin 43 during the rotation of the handle through 90 degrees counterclockwise from the condition in which the window is closed to the condition in which the window is open shutter-like is allowed by the presence of an adapted third inclined surface 49 which is provided on said second pin 43 and interacts with a facing and underlying tab 50 of said second box-like body 45.

Thus, starting from the condition in which the window is closed, a counterclockwise 90-degree rotation of the handle 9 imparts, by virtue of the presence of the cam 12, the maximum possible translatory motion to the first slider 17 and approximately half of the possible motion to the second slider 28, the movement of said second slider being in any case sufficient to allow the disengagement of the free end of the second pin 43 from the second abutment 44.

Again to allow the optimum closure of the window 1, a further pin, with a configuration similar to that of the first pin 33 and of the first box-like body 38 with which it is associated, except for the presence of a lug which performs the function of the lug indicated by the numeral 40, must be applied at the corner between the upper cross-member and the upright 5.

Said further pin, in order to perform the upper closure, is naturally connected to the first cable 10 and can be accommodated, upon a counterclockwise 90-degree rotation from the condition in which the window is closed to the condition in which it is open shutter-like, entirely within its own box-like body.

This condition is in any case also achieved upon a further 90-degree rotation of the handle to pass from the condition in which the door is open shutter-like to the condition in which it is open in a tilt-down manner.

When the window is closed, said further pin is naturally accommodated at an adapted third abutment 51 fixed onto said fixed frame 34.

The device is furthermore constituted by means for coupling to an upper hinge 52 which is adapted to couple the fixed frame 34 at the corner formed by the upper cross-member 2 and by the upright 4.

Said hinge 52 is coupled, by means of a C-shaped plate, to the end of a first rod 54 which constitutes a compass-like arm 57 together with a second rod 55 which is associated with said first rod by means of an adapted fulcrum 56.

More specifically, the rod 54 is rigidly associated with the plate 53, i.e., preferably by welding. In order to permit a tilt-down opening, the third pin 64 does not interact with the plate 53 since it is caused to enter the seat by compressing the spring 66. Thus, during such tilt-down opening, the rod 54 constitutes the only interconnection element acting between the fixed frame which is coupled to the upper hinge 52 and the window.

Furthermore, it will be noted that the plate 53 is connected to the upper hinge 52 and rotates together therewith. The above-mentioned compass arm is movable in a per se known manner and thus will be no further described herein.

Said compass-like arm has, in the interspace between the fulcrum 56 and the plate 53, an articulation 58 which is rotatably associated, at one end, at an adapted support 59 which protrudes from a third box-like body 60 rigidly associated at the upper crosspiece 2.

Said articulation 58 supports the entire window when it is open shutter-like.

A slider 61 is instead provided at the free end of the second rod 55 and is slidable within an adapted longitudinal groove 62 provided on said third box-like body 60, which has adapted holes for the passage of the second cable 11.

A pair of undulated springs 63 is advantageously provided inside the longitudinal groove 62; said springs are adapted to allow a certain movement of the slider 61 within said longitudinal groove 62.

The third box-like body 60 is provided, proximate to the end adjacent to the plate 53, with a seat for a third pin 64 which is shaped like the first pin 33 and is therefore provided with fifth Allen screws 65 which can be accessed from the outside to secure the second cable 11 which is transmitted at the upright 2, said third pin 64 being partially hollowed out.

A fifth cylindrical-helix spring 66 is furthermore provided and is adapted to force said third pin toward a facing hole 67 provided on a wing of said plate 53.

The function of the third pin 64 is as follows: when the window is closed, it connects the upright 2 to the plate 53 and protrudes into the hole 67 toward the hinge 52.

Once the handle 9 has been rotated counterclockwise through 90 degrees in order to pass to the shutter-like opening condition, the cam 12 imparts a movement to the second dowel 14 which imparts a first slight downward movement to the second slider 28, and this causes the partial backward motion of the third slider 64, but said third slider maintains its engagement with the hole 67 provided on the wing of the plate 63: it is thus still possible to perform a shutter-like opening.

After the handle 9 has been rotated through another 90 degrees to reach the tilt-down opening condition, the third pin 64 no longer affects the hole 67 of the wing of the plate 53, allowing to tilt down the window by virtue of the presence of the compass-like arm 57.

FIGS. 29, 30, 31, 32 and 33 illustrate a further embodiment of the coupling to the upper hinge 52, and therefore to the first rod 54, of the third box-like body 60 which is rigidly associated at the upper crosspiece 2.

In this embodiment, the third box-like body 60 has, proximate to the end adjacent to the plate 53, which is hollow and rigidly associated with the upper hinge 52, a seat for a hook 91 which is connected to the second cable 11 and is slidable axially to said seat in contrast with an adapted fifth spring 66.

Said hook 91 interacts with a third pivot 64 which is shaped similarly to the second pivot 43 and can therefore be accommodated within the seat for said hook 91 or be pushed out of it toward the overlying first rod 54 to position itself within an adapted slot 92 defined longitudinally to said first rod 54.

The configuration of the mutually interacting ends of the hook 91 and of the third pivot 64 is such that a first rotation of the handle through ninety degrees obtains an axial sliding of the hook 91 without imparting any movement to said third pivot 64.

Figure 29:
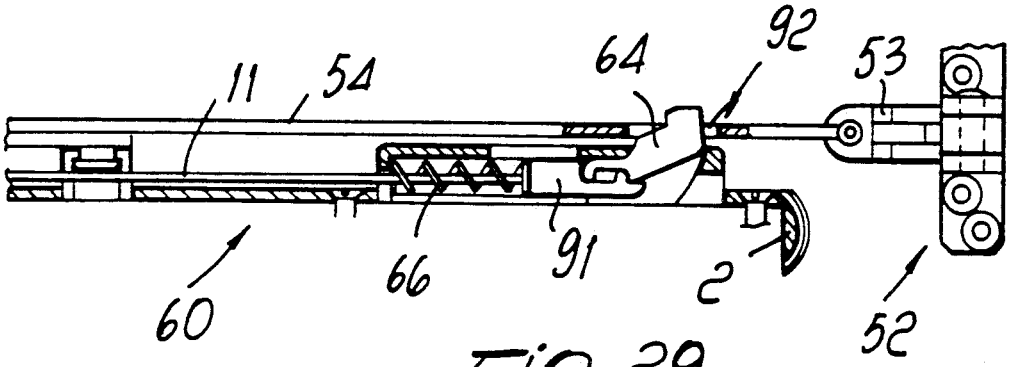
FIGS. 29, 30, 31, 32 and 33 are various partially sectional views of a different embodiment of the coupling between the upper upright and the hinge associated with the frame when the window is closed.
Figure 30:
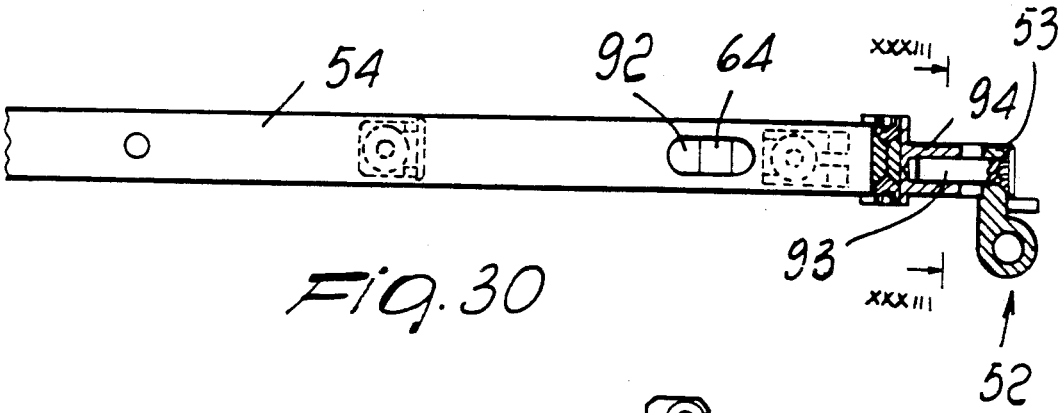
Figure 31:
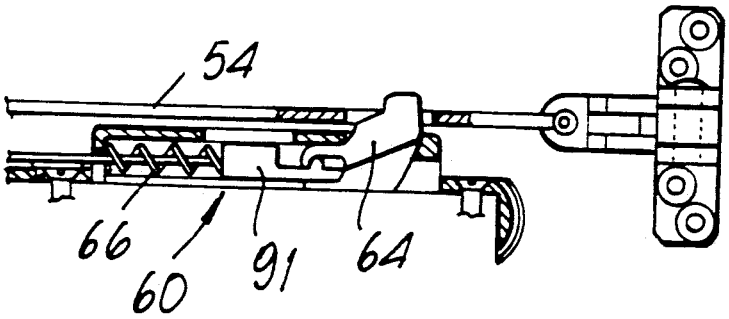

The two conditions are illustrated in FIGS. 29 and 31.

Figure 32:
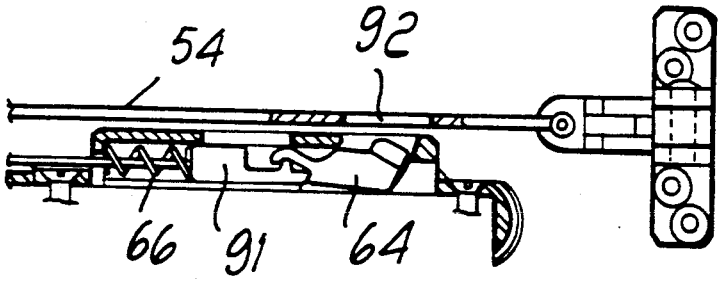
Figure 33:
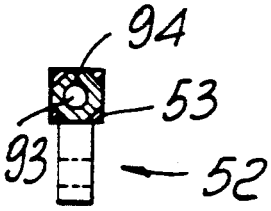

Upon a subsequent rotation through ninety degrees imparted to the handle, the hook 91 imparts a movement to the third pivot 64, as seen from FIG. 32, forcing it to disengage from the slot 92 and arrange itself within the seat defined on the third box-like body 60.

Tilt-down opening is thus allowed.

In order to allow the adjustment of the lateral position of the shutter, there is a sixth screw 93 which is rotatably associated at the plate 53 and controls the axial movement of a square element 94 which is slidably associable at said plate 53.

By then acting on the sixth screw 93 it is possible to adjust the distance between the end of the first rod 54 and the upper hinge 52, and this allows to achieve an optimum seal of the provided gaskets.

The device finally comprises a lower hinge 68 which is axially aligned with the upper hinge 52.

Said lower hinge 68 is advantageously inverted, in that it comprises a male element 69, constituted by a pin 70 of adjustable height, which is provided, at its outer end, with a ball 71 which can be accommodated in a countershaped seat provided on the female element 72 which is coupled to the fixed frame 34.

Said lower hinge 68 is therefore a spherical hinge advantageously made of synthetic material, provided with sliding action for shutter-like opening and articulated action for tilt-down opening: the use of the ball 71 thus allows to prevent the window from assuming, when open, a certain preset position on one hand and, on the other, to achieve the optimum inclination of the pin 70 in the tilt-down opening condition, even in case of incorrect maneuvers such as for example simultaneous shutter-like and tilt-down opening.

In any case, in this last instance the pin 70 follows the inclination of the window without leading to breakage or damage of the hardware.

The fact that the lower hinge 68 is inverted, placing the female element 72 downward, allows to lower the point of rotation without having stresses at the first closure pin 36.

Said lower hinge 68 can advantageously be adjustable both vertically and laterally and be reversible.

Figure 27:
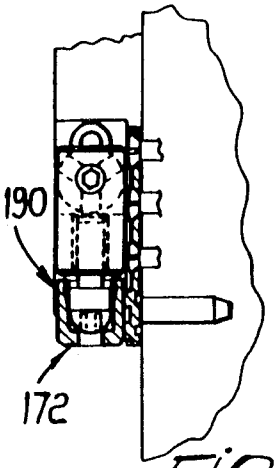
FIGS. 27 and 28 are partially sectional side views of a lower hinge of the device.
Figure 28:
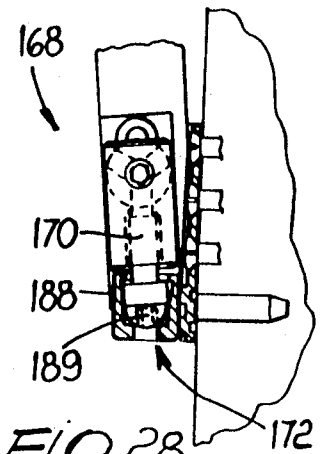

FIGS. 27 and 28 illustrate a further embodiment of the lower hinge 168, which is again constituted by a pin 170 the outer end whereof has a first cylindrical portion 188 followed by a second portion 189 in the shape of a spherical dome.

The seat for said first and second portions defined on the female element 172 is essentially cylindrical, with a seventh region 190 in the shape of a truncated cone with its vertex directed opposite to the pin 170 proximate to the upper opening for the insertion of said first and second portions.

If the window is arranged in a shutter-like opening condition, this configuration allows to locate the first and second portions of the pin 170 within the seat defined on the female element 172, preventing mutual extraction if the window is placed in the tilt down condition.

In this condition, illustrated in FIG. 28, the first portion 188 arranges itself at the seventh frustum-shaped region 190 and thus interacts in abutment with said female element 172 if extraction thereof is attempted.

Figure 7:
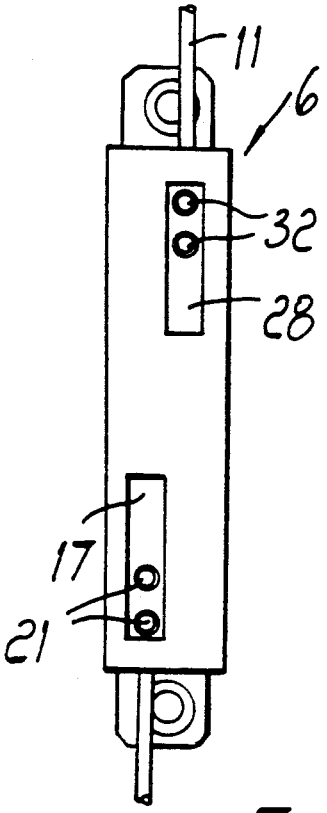
FIG. 7 is a rear view of the box.
Figure 10:
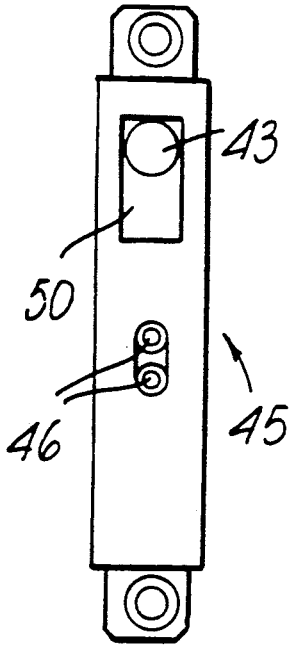
FIG. 10 is a front view of the pawl of the preceding figure.
Figure 8:
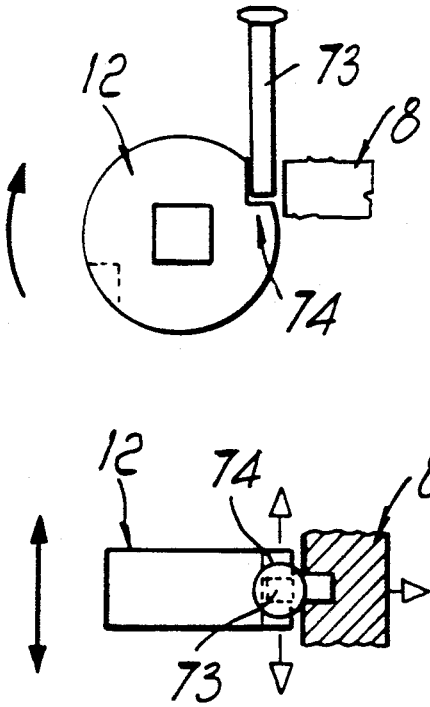
FIG. 8 illustrates, in two schematic views, the means for preventing the rotation of the handle from the shutter-like opening condition to the tilt-down opening condition.
Figure 9:
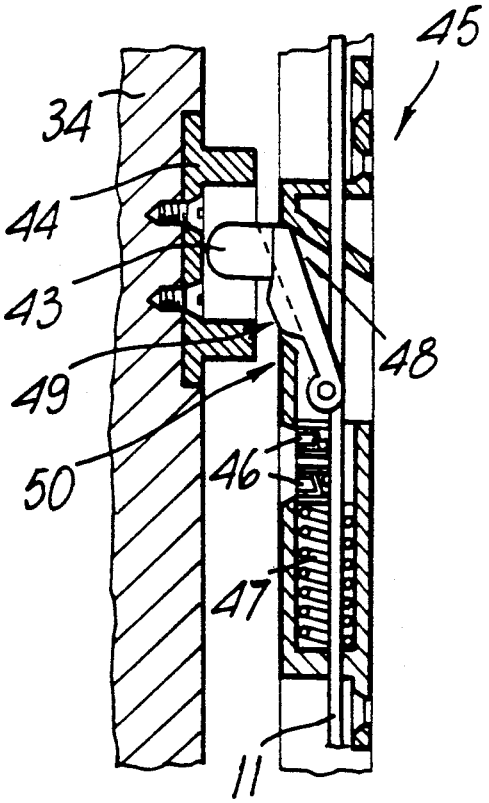
FIG. 9 is a partially sectional view of the intermediate closure pawl.

The device is furthermore constituted by means adapted to prevent the rotation of the handle 9 from the tilt-down opening condition to the shutter-like one, said means being constituted, as shown in FIGS. 6,7 and 8, by an adapted pendulum 73 which is articulated at one end within an adapted seat provided above the cam 12 at the second half-shell 8 and is arranged adjacent, at the other end, to said second half-shell 8 when the window is arranged vertically and therefore in the shutter-like closure and opening conditions.

If the window is placed in the tilt-down opening position, the box 6 is inclined and the cam 12 has undergone a 180-degree rotation with respect to the closure condition illustrated in FIG. 6.

The free end of the pendulum 73 can therefore be positioned at an adapted recess 74 provided transversely to the cam 12.

In this position the cam can no longer rotate, since the pendulum 73 is locked in its position a the adapted seat provided on the second half-shell 8 is no longer arranged facing it unless the window has been returned to a vertical position.

A safety for the user and a stroke limit have thus been provided, since the pendulum 73 prevents the handle from rotating more than 180 degrees starting from the condition in which the window is closed, since the recess 74 interacts with the terminal end of the pendulum 73 which is blocked, at the other end, to the second half-shell 8.

The device can furthermore have, for example at the upper cross-member 2 and at the lower cross-member 3, further pins having the same configuration as the second pin 43 which is not movable perpendicular to the respective cross-member so as to affect a fourth abutment 75 and a fifth abutment 76 associated with the facing fixed frame 34.

Figure 21:
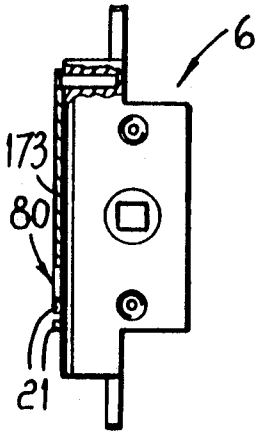
FIGS. 21, 22 and 23 are views of a different embodiment of the means suitable for preventing the rotation of the handle from the tilt-down opening condition to the shutter-like one.
Figure 22:
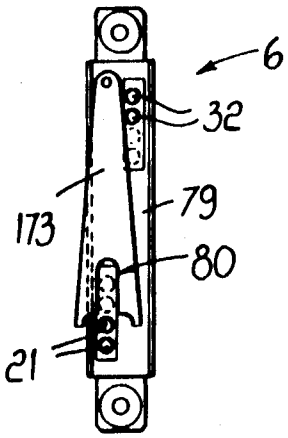
Figure 23:
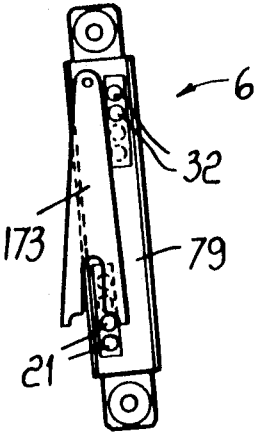

As an alternative, as seen in FIGS. 21,22 and 23, the means suitable for preventing the rotation of the handle from the tilt-down opening condition to the shutter-like one can again be constituted by a suitable pendulum 173 which has an essentially triangular configuration and is arranged outside the box 6 at the front surface 79 from which the first Allen screws 21 and the second Allen screws 32 slightly advantageously protrude.

Advantageously, the pendulum 173 is pivoted, at its vertex, perpendicular to the front surface 79 in a region adjacent to the second Allen screws 32, and a T-shaped seat 80, with its stem directed toward said vertex, is defined at the other end of the pendulum 173.

When the window is open in a shutter-like manner, the pendulum 173 arranges itself as shown in FIG. 22, and the seat 80 allows the axial sliding, with respect to the seat itself, of the first Allen screws 21 which protrude beyond the front surface 79 which is arranged on a plane which is parallel to that of said pendulum 73.

When the window is open in a tilt-down manner, illustrated in FIG. 23, the box 6 is inclined but the pendulum 73 preserves its verticality: in this manner, at least one of the first Allen screws 21 interacts in abutment with one of the wings of the seat 80, and the movement which might lead to shutter-like opening is thus prevented.

Figure 24:
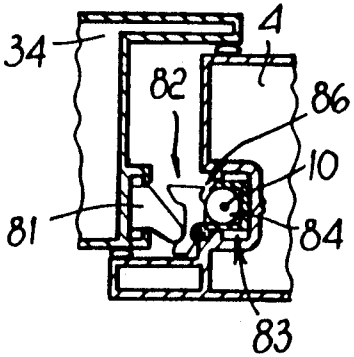
FIGS. 24, 25 and 26 are two partially sectional plan views and a perspective view of a further variated embodiment of the means suitable for preventing the rotation of the handle from the tilt-down opening condition to the shutter-like one.
Figure 25:
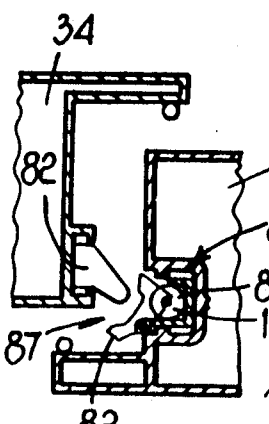
Figure 26:
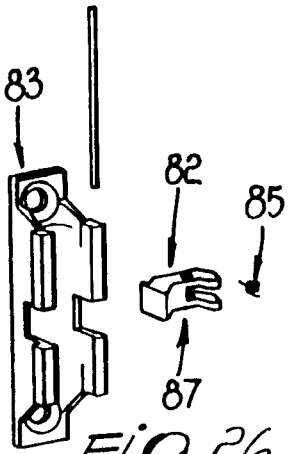

FIGS. 24, 25 and 26 illustrate a further embodiment for the means suitable for preventing the rotation of the handle from the tilt-down opening condition to the shutter-like one: said means are constituted by a wedge-like element 81 associable at the fixed frame 34 and by a hook 82 eccentrically pivoted at a wing of a support 83 which has an essentially U-shaped configuration and is associated with the upright 4 or with both uprights.

Said support 83 is arranged longitudinally to said uprights.

Furthermore, by way of example, the first cable 10 can slide within the support 83; a cylinder 84 is advantageously rigidly coupled to said cable and can slide along said support 83.

The hook 82 is pivoted to a wing of the support 83 and is forced, by means of an adapted sixth spring 85, so as to arrange itself adjacent at the first cable 10 and therefore on the opposite side with respect to the wedge-like element 81.

Advantageously, in this condition the first cable 10 arranges itself at an adapted cavity 86 defined on the hook 82.

On the opposite side said hook has a wall 87 which is slightly curved proximate to the axis of pivoting to the support 83 so that said hook 82 disengages from the cylinder 84 by interacting with the wedge-like element 81 when the window is closed.

Advantageously, said cylinder 84 is arranged below said hook 82 so that when the window opens in a tilt-down manner the first cable 10 is prevented from sliding axially due to the interaction of the cylinder 84 with said hook 82, which is forced by the sixth spring 85 adjacent to said first cable 10.

It has thus been observed that the invention has achieved the proposed aim and objects, a device having been provided which allows to achieve the optimum shutter-like and tilt-down opening of a window while having a very simple structure and being rapidly mountable on said windows.

The device is furthermore manufactured with corrosion-resistant, oxidation-resistant and wear-resistant materials such as brass and thermoplastic materials, whereas the cables are preferably made of galvanized or stainless steel so to be used for example even in a particularly oxidizing or corrosive atmosphere such as for example proximate to the sea.

The box used can furthermore be applied both for rightward and leftward openings, making the amount of stockable material very small, since the use of the cables and pin is independent of the specific configuration of the window.

The device is furthermore provided with a safety against the incorrect shutter-like opening movement starting from the tilt-down opening condition.

The invention is naturally susceptible to numerous modifications and variations, all of which are within the scope of the same inventive concept.

Thus, for example, FIGS. 19 and 20 illustrate a different embodiment for the means adapted to prevent the window from being lifted or opened in the tilt-down condition; said means again comprises a plate 142 with which a cylindrical bush 177 is rotatably associated, said bush having a diametrical groove 178 toward the first box-like body 138 which acts as the temporary seat for the lug 140 which protrudes therefrom.

If the window is arranged in the tilt-down opening condition, the lug imparts a rotation to the bush which therefore locks said window against possible lifting or opening of the lower cross-member.

Similarly, the materials and dimensions of the individual components of the device can be the most pertinent according to the specific requirements.

I claim:

1. Device for the shutter-like and tilt-down opening, with respect to a fixed frame, of a window or door-window composed of an upper cross-member and a lower cross-member connected by a pair of uprights, a handle being rotatably associated on one of said uprights, said device comprising a box, arranged on one of said uprights, which is provided with means, actuated by said handle, for tensioning at least one traction element which actuates a plurality of pins for the temporary closure onto said fixed frame and for coupling to an upper hinge for shutter-like or tilt-down opening, said device comprising a lower spherical hinge with friction means for shutter-like opening and articulated for tilt-down opening, said box comprising means adapted to prevent the rotation of said handle from the tilt-down opening condition to the shutter-like opening condition, said box being composed of a first and second mutually associated half-shell, wherein said tensioning means are constituted by a cam which has a seat for actuation by means of said handle, said cam interacting with a first and a second dowel which have an essentially cylindrical shape, said cam having a width which is approximately equal to the interspace between said first and said second half-shell and having profiles with a different configuration at said half-shells, said cam having, at said first half-shell, a first planar region on which said first dowel rests when the window is closed, an end of said first dowel being accommodated at an adapted seat provided on said first half-shell while the other end interacts with a first wing of a first slider which has an essentially L-shaped configuration, said first slider being slidably associated at an adapted longitudinal seat provided on said first half-shell.

2. Device according to claim 1, wherein an adapted first pawl is provided at said first wing of said first slider and protrudes on the opposite side with respect to the side which interacts with said first dowel, a first cylindrical-helix compression spring being located at said pawl, locking means for said first cable, such as first Allen screws, being associated with the second wing of said first slider.

3. Device according to claim 1, wherein said cam is furthermore provided with a second pawl with elliptical configuration which is offset by 90 degrees clockwise with respect to said first region and is followed, upon a further clockwise 90- degree rotation, by a third region with constant radius.

4. Device according to claim 1, wherein said cam has a fourth region at said second half-shell, said fourth region being also planar and resting, when the window is closed, at said facing second dowel, a fifth region with constant radius being provided on said cam upon a clockwise 90-degree rotation with respect to said fourth region, said fifth region being followed, upon a further 90-degree clockwise rotation, by a sixth region with elliptical configuration.

5. Device according to claim 4, wherein one end of said second dowel is accommodated, at said second half-shell, on the opposite side with respect said first dowel relative to said cam, at an adapted seat provided on said second half-shell, its other end interacting with a third wing of a second slider which has an L-shaped configuration and is slidably associated at an adapted longitudinal seat again provided on said second half-shell.

6. Device according to claim 5, wherein a second pawl protrudes at said third wing of said second slider in the opposite direction with respect said second dowel, said second pawl interacting with an adapted second cylindrical-helix compression spring, said second slider having a fourth wing provided with coupling means such as second Allen screws for said second cable which protrudes on the opposite side with respect to said first cable.

7. Device according to claim 1, wherein an adapted first pawl is provided at said first wing of said first slider and protrudes on the opposite side with respect to the side which interacts with said first dowel, a first cylindrical-helix compression spring being located at said pawl, locking means for said first cable, such as first Allen screws, being associated with the second wing of said first slider, and wherein a second pawl protrudes at said third wing of said second slider in the opposite direction with respect to said second dowel, said second pawl interacting with an adapted second cylindrical-helix compression spring, said second slider having a fourth wing provided with coupling means such as second Allen screws for said second cable which protrudes on the opposite side with respect to said first cable, and wherein access openings for said first and second Allen screws are provided on both of said first and second half-shells.

8. Device according to claim 1, wherein upon a 90-degree rotation, which is counterclockwise if said handle is used on the left upright, imparted to said handle, said cam imparts a maximum upward movement to said first slider connected to said first cable and simultaneously imparts an intermediate downward movement to said second slider which is connected to said second cable so as to allow the shutter-like opening of said window.

9. Device according to claim 1, wherein said first cable is connected to a first pin for the temporary closure of said window onto a fixed frame, said first pin being partially hollow for the passage of said first cable and having adapted means, constituted by third Allen screws, for locking said cable, said first pin being therefore arranged adjacent at one or both of said uprights, its end which is partially removed toward said lower cross-member being forced to protrude, when the window is closed, beyond said lower cross-member by means of an adapted third cylindrical-helix spring within a first abutment which is associated with said fixed frame.

10. Device according to claim 9, wherein said third spring and first pin are slidably associated at an adapted longitudinal seat provided on a first box-like body which is rigidly associated with one of said uprights which is upwardly perforated for the passage of said first cable.

11. Device according to claim 10, wherein said first box-like body furthermore comprises a means adapted to prevent said window from being lifted if it is in the tilt-down condition, said means being constituted by a lug which protrudes from the opposite side with respect to one of said uprights and is accommodated within an adapted cavity provided on a plate which is rigidly coupled to said fixed frame.

12. Device according to claim 9, wherein a maximum movement imparted to said first slider to allow the disengagement of the free end of said first pin from said first abutment corresponds to a 90-degree counterclockwise rotation of said handle, said abutment being internally provided with a first inclined surface adapted to facilitate the tilt-down opening of said window, said cam interacting, in this last condition, which corresponds to a 180-degree rotation of said handle starting from the closure condition, with said first dowel at said third region so as to arrange said first dowel in an intermediate position which is in any case sufficient to allow the partial protrusion of the free end of said first pin from said first box-like body.

13. Device according to claim 1, wherein the end of a second intermediate closure pin is pivoted to said second cable, said second pin having an essentially L-shaped configuration, the other end thereof, which is free, protruding transversely to one of said uprights toward said facing fixed frame within an adapted second abutment, said second pin being slidably accommodated within a second box-like body which is perforated above and below for the passage of said second cable and has fourth Allen screws for the fixing of said second cable, said second pin being forced toward said upper cross-member by means of an adapted fourth cylindrical-helix compression spring.

14. Device according to claim 13, wherein the free end of said second pin performs a movement which is approximately perpendicular with respect to said second box-like body, which is upwardly provided with a second inclined surface which interacts with the upper end of said second pin during the positioning of the handle from the condition in which the window is open shutter-like to the condition in which the window is closed by virtue of the presence of said fourth spring.

15. Device according to claim 14, wherein the transverse translatory motion of the free end of said second pin during the step of 90-degree counterclockwise rotation of the handle from the condition in which the window is closed to the condition in which the window is open shutter-like is allowed by the presence of an adapted third inclined surface which is provided on said second pin and interacts with a facing and underlying tab of said second box-like body.

16. Device according to claim 1, comprising means for coupling to an upper hinge which is adapted to couple said fixed frame at the corner formed by the upper cross-member and by one of said uprights, said hinge being coupled, by means of a C-shaped plate, to the end of a first rod which constitutes, together with a second rod which is associated with said first rod by means of an adapted fulcrum, a compass-like arm which has, in the interspace between said fulcrum and said plate, an articulation which is rotatably associated, at one end, at an adapted support which protrudes from a third box-like body which is rigidly associated at the upper cross-member.

17. Device according to claim 16, wherein a slider is provided at the free end of said second rod, said slider being slidable within an adapted longitudinal groove which is provided on said third box-like body, said third box-like body having adapted holes for the passage of said second cable.

18. Device according to claim 16, wherein a pair of undulated springs is provided inside said longitudinal groove, said spring being adapted to allow a certain movement of said slider within said longitudinal groove.

19. Device according to claim 16, wherein said third box-like body has, proximate to the end adjacent to said plate, which is hollow and rigidly associated with said upper hinge, a seat for a hook which is connected to said second cable and is slidable axially to said seat in contrast with said fifth spring, said hook selectively interacting with a third pivot which is shaped similarly to said second part and can be fully accommodated within said seat for said hook when the window is in the tilt-down open condition or protrude at an adapted slot defined longitudinally at said overlying first rod when the window is closed or open shutter-like.

20. Device according to claim 16, wherein in order to allow adjustment of a lateral position of said shutter said upper hinge has, at said plate, a sixth screw which is freely rotatably associated therewith and is adapted to actuate the axial movement of a square element which is slidably associated with said plate and is coupled to said first rod.

21. Device according to claim 16, wherein said third box-like body is provided, proximate to the end which is adjacent to said plate, with a seat for a third pin which has adapted fifth Allen screws which can be accessed from the outside to lock said second cable, said third pin being partially hollowed out for the transmission of said second cable at the upright and being forced by a fifth spring toward a facing hole provided on a wing of said plate said third pin connecting, when the window is closed, said upper upright to said plate, said pin protruding within said hole toward said hinge.

22. Device according to claim 21, wherein said third pin maintains an engagement with said hole provided on said wing of said plate following a 90-degree counterclockwise rotation of said handle to pass to the condition in which the door is open shutter-like.

23. Device according to claim 21, wherein said third pin is disengaged from said hole provided on said wing of said plate after a rotation of 180 degrees from the closure condition to the tilt-down opening condition.

24. Device according to claim 1, comprising a lower hinge which is axially aligned with said upper hinge and can be adjusted both vertically and laterally, said hinge being advantageously inverted in that is comprises a male element, constituted by a pin with adjustable height which is provided at its outer end with a sphere made of synthetic material which is accommodated in a countershaped seat provided on a female element which is rigidly associated with the fixed frame, the reversal of said lower hinge allowing to lower the rotation point without having stresses at said first closure pin.

25. Device according to claim 1, comprising means adapted to prevent the rotation of said handle from the tilt-down opening condition to the shutter-like opening condition, said means being constituted by an adapted pendulum which is articulated, at its upper end, in an adapted seat provided above said cam at said second half-shell and arranged, at its other end, adjacent to the rear wall of said second half-shell when the window is arranged vertically and therefore in the shutter-like opening and closure conditions.

26. Device according to claim 25, wherein the free end of said pendulum can be arranged at an adapted recess provided transversely to said cam if said window is arranged in the tilt-down opening condition, any further rotation in any direction being prevented for said cam in said position unless the window is first returned to a vertical position.

27. Device according to claim 25, wherein said means suitable for preventing the rotation of said handle from the tilt-down opening condition to the shutter-like one are constituted by a pendulum with triangular configuration which is arranged externally and parallel to said box at the front surface from which said first and second Allen screws protrude, said pendulum being freely pivoted at the vertex in a region to said second Allen screws and having, on the opposite side, a T-shaped seat the stem whereof, which is directed toward said vertex, allows the axial sliding of said first Allen screws when the window is open shutter-like, the wings of said seat locking the sliding of said first Allen screws when the window is open in a tilt-down manner.

28. Device according to claim 25, wherein said means adapted to prevent the rotation of said handle from the tilt-down opening condition to the shutter-like one are constituted by a wedge-like element which is associable with, and protrudes from, said fixed frame, and by a hook which is eccentrically pivoted at a wing of a support which is U-shaped and is associable with one or both of said uprights, said wedge-like element interacting with said hook when the window is closed.

29. Device according to claim 28, wherein at least said first cable slides axially to said support, at least one cylinder being rigidly associated with said cable, said cylinder abutting, when the window is in tilt-down open position, with said overlying hook, said hook being forced to arrange itself, by means of an adapted sixth spring, adjacent to said first cable at an adapted cavity defined on said hook.

30. Device according to claim 28, wherein the wall of said hook which interacts with said wedge-like element is slightly curved proximate to the axis of pivoting to said support so as to allow, when the window is closed, the disengagement of said hook from said cable and cylinder, said cylinder being able to slide freely with respect to said support upon an activation of said first cable.

31. Device according to claim 1, comprising a means adapted to prevent the lifting or opening of said window in the tilt-down opening condition, constituted by a cylindrical bush which is rotatably associated with a plate which is fixed to said fixed frame, said bush having a diametrical groove which is the temporary seat for a lug which protrudes from said first box-like body.

32. Device according to claim 1, wherein said lower hinge is constituted by a pivot the outer end whereof has a first cylindrical portion followed by a second portion in the shape of a spherical dome, said first and second portions being accommodatable in a cylindrical seat defined on said underlying female element, said seat having, at the opening for the insertion of said first and second portions, a seventh region with a frustum-like shape with the vertex directed opposite to said pivot, said configuration allowing to lock the extraction of said first and second portions from said female element when the window is in tilt-down open condition.

33. Device for the shutter-like and tilt-out opening of a window or door-window structure (1) with respect to a fixed frame means (34), said device comprising a first hinge means (68) interconnected between said structure (1) and said fixed frame means (34) which allows pivoting of said structure (1) with respect to said fixed frame means (34) about both a first tilt-out pivoting axis (3) and a second shutter-like pivoting axis (4), said first and second axes being substantially mutually orthogonal, said first hinge means (68) being arranged substantially at a point where said first and second axes intersect, a second hinge means (52) interconnected between said structure (1) and said fixed frame means (34) which also allows pivoting of said structure (1) with respect to said fixed frame means (34) about both said first and second axes, said second hinge means (52) being arranged substantially on said second pivoting axis (4) at a distance away from said first pivoting axis (3), releasable connection means (37,45,51) at least temporarily connected between said structure (1) and said fixed frame means (34), a manipulation handle means (6) rotatably connected to said structure (1), and traction element means (10,11) and tensioning means (12), said traction element means (10,11) being interconnected between said second hinge means (52) and said tensioning means (12), said traction element means (10,11) also being interconnected between said releasable connection means (37,45,51) and said tensioning means (12), said tensioning means (12) being actuable by said manipulation handle means (6) to thereby controllably tension said traction element means (10,11) for selectively operating said connection means (37,45,51) and said second hinge means (52) for the shutter-like or the tilt-down opening of said structure (1) with respect to said fixed frame means (34), wherein said tensioning means comprises a cam element (12), said traction element means comprising a first spring-loaded traction element (10) and a second spring-loaded traction element (11), said cam element (12) defining a first cam profile (15,22,23) for tensioning said first spring-loaded traction element (10) and a second cam profile (24,25,26) for tensioning said second spring-loaded traction element (11), said first (15,22,23) and said second (24,25,26) cam profiles respectively tensioning said first (10) and said second (11) spring-loaded traction elements simultaneously upon actuation of said manipulation handle means (6).

34. Device according to claim 33, wherein said cam element (12) has an essentially cylindrical shape which defines a first cylindrical side and a second cylindrical side, said first cam profile being defined on said first cylindrical side of said cam element (12) and comprising, in a manner which successively extends 360 degrees about said first cylindrical side, a first planar surface (15), a second elliptical surface (22), and a third circular surface (23), said second cam profile being defined on said first cylindrical side of said cam element (12) and comprising, in a manner which successively extends 360 degrees about said second cylindrical side, a fourth planar surface (24), a fifth circular surface (25), and a sixth elliptical surface (26).

35. Device according to claim 34, wherein said first cam profile (15,22,23) and said second cam profile (24,25,26) are substantially mutually inverted by 180 degrees with respect to a center axis of said cylindrical shaped cam element (12).

* * * * *